United States Patent [19]

LeMay

[11] 3,987,836

[45] Oct. 26, 1976

[54] SCREEN PARTITION ASSEMBLY

[75] Inventor: Andre LeMay, Laval, Canada

[73] Assignee: Standard Desk Limited, Canada

[22] Filed: Feb. 19, 1975

[21] Appl. No.: 550,985

[52] U.S. Cl. ..... 160/135; 160/351

[51] Int. Cl.[2] ..... A47G 5/00

[58] Field of Search ..... 160/135, 351

[56] References Cited

UNITED STATES PATENTS

| | | | |
|---|---|---|---|
| 3,605,851 | 9/1971 | Miles et al. | 160/351 X |
| 3,735,794 | 5/1973 | Lebowitz | 160/351 X |
| 3,766,692 | 10/1973 | Stark | 160/351 X |
| 3,809,142 | 5/1974 | Bleeker | 160/135 |

*Primary Examiner*—Kenneth Downey

*Attorney, Agent, or Firm*—Robert F. Rotella; Norman Friedman; Stephen A. Roen

[57] ABSTRACT

A modular screen partition system includes a mounting post containing inserts which permit the joining of any desired number of partitions to the post while permitting complete angular orientation capability in a light- and sound-proof assembly. The inserts, located within the top and bottom interior of the mounting post are retained by means of a plug preventing lateral movement and a post to which a cover cap is secured. A bolt associated with each insert is engaged by a mounting track provided at each side edge of the screen partition.

7 Claims, 6 Drawing Figures

SCREEN PARTITION ASSEMBLY

BACKGROUND AND SUMMARY OF THE INVENTION

The present invention relates to a modular screen partition system intended for use in large open areas in which it is desirable to create separate work stations such as are found in modern office environments.

Wall or panel assemblies of this type have already been introduced but are difficult to erect since all the panels which are supported by a center column or post must be positioned simultaneously in order to be properly joined to the column. This type of construction requires using several workmen to hold the panels in proper position just prior to joining. Furthermore, once the panels have been joined to the column their angular orientation cannot be changed without at least a partial disassembly of the center column hardware thus risking losing the proper angular orientation of the remaining panels.

Other disadvantages of known systems include the inability to adjust the panels through a full 360° angular orientation and the existence of gaps between the panel edge and the center column which permit the wall assembly to pass objectionable light and sound between the two sides.

These and other disadvantages are overcome in accordance with the present invention which provides a modular screen partition assembly which can be readily constructed by only one person and which can be easily modified to suit future requirements by adding or removing screen sections without disturbing already existing screen. In addition, partial factory assembly of the column hardware is possible, making on the job assembly rapid and inexpensive. The screens are light proof and sound tight and can be oriented through a full circle.

The above objects and additional novel features of the present invention will become readily apparent by reference to the following detailed description when read in connection with the appended drawings.

DETAILED DESCRIPTION OF THE INVENTION

Figure 1:
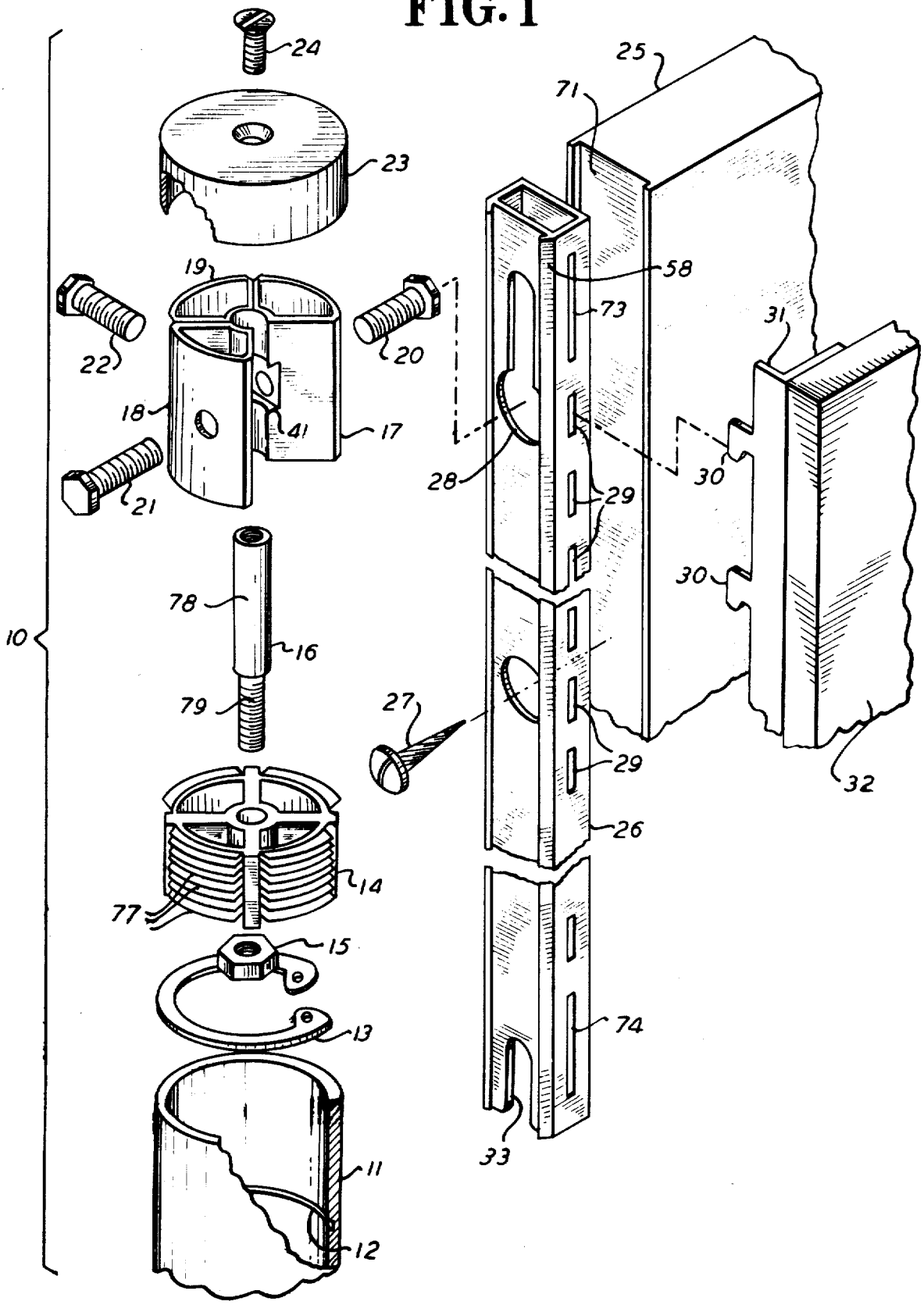
FIG. 1 is an exploded view of the components of the center post, a screen partition and work unit in accordance with the invention.

Referring now to FIG. 1, column assembly 10 comprises a center connecting post 11 of hollow metal construction, provided with two internal grooves 12 located inwardly of the two ends. An internal snap ring 13 inserted into each groove serves as an abuttment wall to prevent the remaining components of the assembly from sliding into the post 11 interior.

Plug 14 is of a generally cylindrical configuration with its exterior surface having a series of circumferential deformable vanes 77 allowing the plug to be press fitted within the interior of post 11. Plug 14 includes a central bore for accommodating pivot post 16 which is in the form of a rod having an exterior partially screw-threaded portion 79 and a partially smooth portion 78. A nut 15 tightened against the threads of pivot post 16 joins post 16 to plug 14.

Plug 14 is then forced into the bore of post 11 until it abuts against snap ring 13. Vanes 77 are deformed against the interior wall of the post 11 and face slightly towards the end of the post thereby preventing the plug 14 from being readily pulled out. The smooth portion 78 of pivot post 16 extends slightly above the end of post 11. Each of the connecting posts 11 is provided at its both ends with a plug 14 and pivot post 16, regardless of the number of screen partitions which are to be joined to the respective posts.

The top of plug 14, pivot post 16 and the interior surface of connecting post 11 thus define a cup-shaped structure. Into each end of the post 11 are then inserted the desired number of rotatable inserts corresponding to the number of screen partitions which are to be joined to that center post 11. For purposes of illustration, FIG. 1 shows three inserts 17, 18 and 19 which can correspondingly accommodate three screen partitions.

Each of the inserts 17, 18, 19 is segment of a cylinder in shape. The curvature of the external wall of each insert conforms to the curvature of the bore of post 11 while the internal curvature of the insert conforms to the curvature of the pivot post smooth portion exterior 78, thereby allowing the inserts to be oriented at any desired angle with respect to the axis of post 11. Although the inserts are here disclosed as being of hollow thin wall construction, it is to be understood that they may be formed entirely of solid construction as well.

Figure 4:
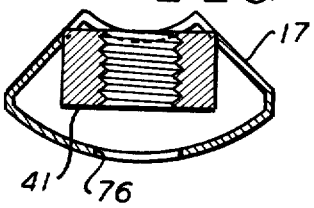
FIG. 4 is a sectional view taken along line 4—4 of FIG. 3.
Figure 3:
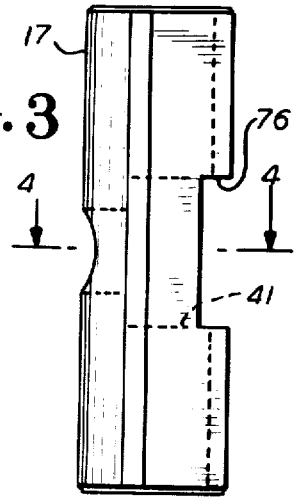
FIG. 3 is an elevation of the insert member utilized in accordance with the invention.

Perpendicular to the longitudinal axis of each insert is an internally-threaded portion 41 (here shown associated with insert 17) which may be best seen by reference to FIGS. 3 and 4. Threaded portion 41 functions as a nut and accommodates a threaded bolt 20 which, inserted through a hole provided in the external wall of insert 17, engages the threads of nut 41, and is tightened against the smooth portion 78 of pivot post 16. After the required number of inserts corresponding to the number of wall partitions to be joined to the post 11 have been positioned at the angles at which the partitions are to be positioned, each bolt 20 is hand tightened to guard against their shifting pending final assembly of the partitions.

Figure 2:
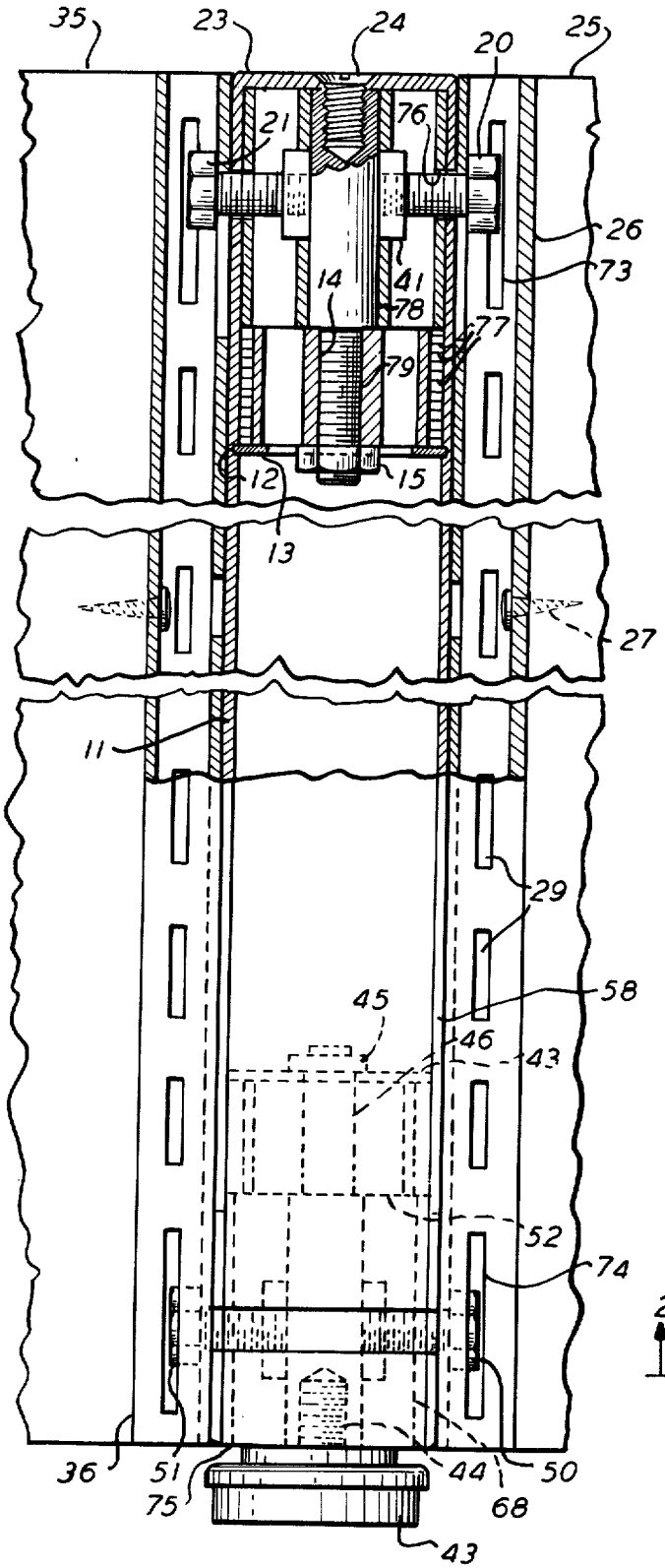
FIG. 2 is a sectional view taken along line 2—2 of FIG. 6 showing a center post to which two screen partitions are joined.

A post cap 23 is then positioned over the top end of post 11 and a cap screw 24 inserted through the top of cap 23 thereby engaging internal threads provided at the smooth end portion 78 of pivot post 16. The bottom end of post 11, as may be best seen in FIG. 2, also includes a cap member 75. However, instead of a cap screw, a conventional rubber and metal floor glide 43 having a bolt 44 is threaded into position.

Each screen partition 25 includes at its lateral edge a mounting track 26. Preferably, the lateral edge of partition 25 includes a shallow channel 71 into which mounting track 26 is inserted during assembly. Track 26 is fastened to partition 25 by means of mounting screws 27 inserted through the side edge thereof. Also formed in the edge of track 26 at the top portion is a key hole slot 28 which is designed to engage the head of bolt 20 associated with insert 17. An open slot 33 formed at the edge of the bottom of track 26 engages the head of bolt 50 associated with an insert 68 located at the bottom portion of post 11.

Screen partition 25 is positioned abutting post 11 by first engaging the head of bolt 50 in lower slot 33 and then engaging bolt 20 in keyhole 28. The upper and lower mounting bolts 20 and 50 are then permanently tightened by use of an open-end wrench inserted into the elongated slots 73, 74 located at the top and bottom, respectively, of the front portion of the mounting track 26.

A series of rectangular slots 29 is formed along the entire front surface of track 26. These slots are designed to engage corresponding hooks 30 associated with a mounting bracket 51 thereby permitting mounting of a work unit 32 at any desired height along the partition 25. Work unit 32 may be a desk top, shelf, cabinet, display board or the like or combinations of such units disposed in any desired configuration.

Figure 5:
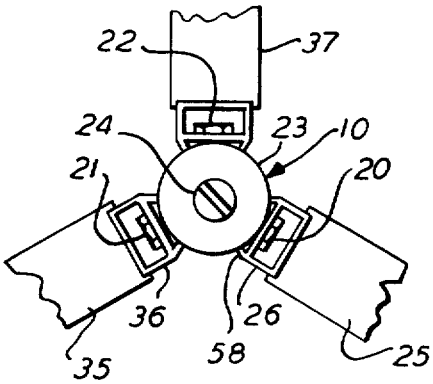
FIG. 5 is a plan view of a center post to which three screen partitions have been joined.

Referring to FIG. 5, there is shown an assembly of three partitions 25, 35 and 37 spaced at an equal angular distance from the axis of a center post 23, thus providing three separate work areas. Mounting tracks 26, 36, and 38, respectively, engage the heads of bolts 20, 21, and 22 for fastening the associated partitions to post 23.

Figure 6:
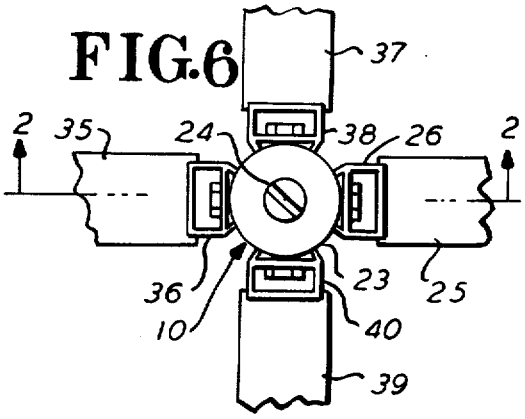
FIG. 6 is a plan view of a center post to which four screen partitions have been joined.

In FIG. 6 an additional partition 39 has been joined to center post 23 through its mounting track 40. The four partitions 25, 35, 37 and 39 are disposed in an orthogonal arrangement thus forming four separate work stations.

Although only a single center post to which various numbers of screen partitions are joined have been disclosed by illustration, it is to be understood that other posts may be joined to the free ends of the partitions and additional partitions added on, in "domino" fashion followed by more posts and partitions to form any desired array of work stations.

Referring again to FIG. 1, the mounting track 26 of screen 25 includes chamfered strips 58 on both faces adjacent to the portions carrying mounting hols 29. When joined to column 11, strips 58 compensate for the curvature of the external surface of column 11 which would otherwise abutt the flat edge of the mounting track 26 on which slots 28 and 33 are formed. Thus, the light-and acoustic-tightness of the arrangement is preserved.

Each screen partition 25 may be constructed with hollow condvits to accommodate, respectively, electrical power and communications cables brought from ceiling or floor junction boxes. In this manner electrical appliances, lighting fixtures and telephone and data transmission equipment can be readily connected at each work station to suitable outlets on the surface of the partition without the need for dangerous extension cables or expensive rewiring.

If desired, the column hardware may be factory installed for ease of later assembly. For instance, the cap or glide, the maximum number of inserts, post and plug may all be shipped installed with the assembler having to add only those mounting bolts as are necessary for joining the required partitions to the column.

Furthermore, the post, plug and retaining ring combination may be formed as part of the column during its manufacture, if desired.

I claim:

1. A modular screen partition system comprising:

column means capable of supporting a plurality of screen partitions comprising a column having hollow interior portions at each end thereof;

supporting means located within each of said interior portions;

said supporting means comprising plug means fixedly mounted within said column interior and a post coaxial with said column axis;

said plug means including a core; said post being substantially an extension of said core; and at least one generally wedge-shaped member disposed within each of said interior portions;

said supporting means permitting angular rotation of said member while preventing axial movement of said member;

said member having a first edge disposed about said post and a second edge disposed about the hollow interior surface of said column; the edges of said member extending beyond the end of said column;

said member being provided with a threaded portion for fastening cooperation with a corresponding threaded element;

said threaded element comprising a bolt extending in a radial direction relative to said column axis through the first and second edges of said member;

said threaded element including an inner portion capable of contacting the surface of said post for locking said member against rotation about said post and an outer portion for cooperating with a partition to be joined to said column;

said threaded element including an outer portion including an enlarged head;

each partition to be joined to said column including a head-engaging slot disposed at the edge of said partition for engaging said threaded element head;

members at each end of said column means in paired relationship parallel to said column axis joining a partition to said column means through a respective head-engaging slot and a respective threaded element head.

2. A modular screen partition system as set forth in claim 1, wherein:

said column means further includes cover means for covering each end of said column;

each of said cover means including a cap portion for enclosing a portion of the edges of said member extending beyond the end of said column;

said threaded element extending through the gap formed between the end of said column and said cap portion.

3. A modular screen partition system as set forth in claim 1, wherein:

said partition includes at each edge thereof a mounting track having an external edge and two face portions;

the external edge of said mounting track including said head-engaging slot and said face portions including hook-engaging apertures for cooperating with hook members associated with an accessory device for support thereof by said partition.

4. A modular screen partition system as set forth in claim 3, wherein:

said mounting track face portions are at least partially covered by corresponding face portions of said partition;

said mounting track further including a chamfered strip associated with each of said track face portions for engagement with the external surface of said column; whereby said column, said strip and said partition face portions form a surface impervious to light and sound.

5. A modular screen partition system as set forth in claim 2, wherein:

said cover means is secured to said post;

one of said cover means including a foot portion capable of supporting said column on a floor surface.

6. A modular screen partition system as set forth in claim 1, wherein:

said plug means comprises a plug-shaped member the outer surface of which includes resilient means for cooperating with the interior surface of said column to thereby firmly engage said plug-shaped member and said column.

7. A modular screen partition system as set forth in claim 1, wherein:

said column interior is provided with a ring-shaped wall against which said plug-shaped member rests.

* * * * *